US005123391A

United States Patent [19]

Ohkubo et al.

[11] Patent Number: 5,123,391

[45] Date of Patent: Jun. 23, 1992

[54] ELECTRONIC CONTROL FUEL INJECTION DEVICE A FOR AN INTERNAL COMBUSTION ENGINE

[76] Inventors: Satoru Ohkubo, Kenkyusho, 1-1, Tsukaguchihonmachi 8-chome, Amagasaki-shi, Hyogo-ken; Akira Demizu, 840, Chiyoda-cho, Himeji-shi, Hyogo-ken, both of Japan

[21] Appl. No.: 731,229

[22] Filed: Jul. 17, 1991

[30] Foreign Application Priority Data

Sep. 12, 1990 [JP] Japan ..... 2-243540

[51] Int. Cl.[5] ..... F02D 41/18

[52] U.S. Cl. ..... 123/435; 123/494

[58] Field of Search ..... 123/425, 435, 494; 73/118.2

[56] References Cited

U.S. PATENT DOCUMENTS 4,840,159 6/1989 Matsumoto ..... 123/585
4,905,648 3/1990 Washino ..... 123/425
4,905,649 3/1990 Washino ..... 123/435
4,913,118 4/1990 Watanabe ..... 123/435
4,971,009 11/1990 Washino et al. ..... 123/435
5,038,737 8/1991 Nishiyama et al. ..... 123/435

FOREIGN PATENT DOCUMENTS 221433 12/1984 Japan .
142228 6/1989 Japan .

*Primary Examiner*—Tony M. Argenbright

[57] ABSTRACT

An electronic control fuel injection device for an internal combustion engine having an inner cylinder pressure sensor for detecting a pressure of a combustion chamber of the internal combustion engine; a crank angle sensor for detecting a crank angle; a device for synthesizing the detected inner cylinder pressure by predetermined crank angles; a device for calculating an intake air quantity based on an engine revolution number which is obtained from the synthesized inner cylinder pressure and the crank angle; a device for synthesizing the calculated intake air quantity in predetermined cycles; and a device for calculating a fuel injection quantity based on the synthesized intake air quantity.

1 Claim, 6 Drawing Sheets

CB

C

CL

P
P2-47
P1-0

T

CA
BDC
BDC+90°
BDC+137°
TDC
INTAKE AIR
VALVE CLOSED

ELECTRONIC CONTROL FUEL INJECTION DEVICE A FOR AN INTERNAL COMBUSTION ENGINE

BACKGROUND OF THE INVENTION

1. Field of the Invention

This invention relates to an electronic control fuel injection device for an internal combustion engine.

2. Discussion of Background

In a conventional electronic control type internal combustion engine, fuel injection quantity is measured by an output signal of an air-flow meter and an engine revolution number. However, in case of the air-flow meter, the intake air quantity can not accurately be measured, since the air-flow meter suffers influence of intake air pulsation when a throttle valve is fully open. Furthermore when a supercharger is installed in the engine, the range for measuring the intake air quantity becomes too wide for the air-flow meter to accurately measure the intake air quantity, over the whole range of the measurement. Therefore the measurement accuracy of the air-flow meter of the intake air quantity in its low flow quantity region and its high flow quantity region, has to be lowered. As a result, when a supercharger is installed in the engine, it becomes difficult to make an air fuel ratio of a mixture to be supplied to a cylinder of the engine, agree accurately to a predetermined air fuel ratio, in the low flow quantity region and the high flow quantity region. Even when the supercharger is not installed of the engine, it is difficult to make the air fuel ratio of a mixture to be supplied to the cylinder of the engine, agree to a predetermined air fuel ratio, when the throttle valve is fully open.

To solve the above problem, in Japanese Unexamined Patent Publication No. 221433/1984, an inner cylinder pressure sensor is introduced, which directly detects a pressure in the cylinder. The air fuel ratio control is performed by calculating the fuel injection quantity which is injected from a fuel injection valve, based on the output of this inner cylinder pressure sensor.

FIG. 1 shows the composition of such conventional device. A reference numeral 1 designates an engine, 2, a piston, 3, a combustion chamber, 4, an intake air valve, 5, an intake air port, 6, a surge tank, 7, a branch pipe which connects the intake air ports 5 of respective cylinders, and the surge tank 6, 8, an intake air duct, 9, a throttle valve installed in the intake air duct 8, 10, an air cleaner, 11, a water temperature sensor which detects a temperature of cooling water of the engine, and 12, a fuel injection valve installed at the branch pipe 7. Fuel is injected from the fuel injection valve 12 to the corresponding intake port. The inner pressure sensor 13 is installed in the combustion chamber 3, which detects an inner cylinder pressure. The electronic control unit 20 is composed of a digital computer, which has the CPU (microprocessor) 22, the ROM 23, RAM 24, the input port 25, and the output port 26, which are interconnected by the bi-directional bus 21. The water temperature sensor 11 generates an output voltage which is proportional to the temperature the cooling water of the engine. This output voltage is inputted to the input port 25, after it is converted to a corresponding binary signal by the AD convertor 27. The inner cylinder pressure sensor 13 generates an output voltage which is proportional to the pressure in the combustion chamber 3. The output voltage is inputted to the input port 25, after it is converted to a binary number by the AD convertor 28. The crank angle sensor 29 generates an output pulse signal at every 1 degree of crank angle. This output signal is inputted to the input port 25. The crank reference position sensor 30 generates the reference position pulse signal at the timing when the intake air valve 4 is closed and a predetermined crank angle elapses. Accordingly, this reference position of signal is generated at every 720° of the crank angle. This reference position signal is inputted to the input port 25. The output port 26 is connected to the fuel injection valve 12 of the respective cylinder, via the drive circuits 31 through 34. Fuel is injected from the fuel injection valve 12, at every 720° in crank angle, at the timing respective to each cylinder.

Next, explanation will be given to the operation. The pressure in the combustion changer 3, is detected by the inner cylinder pressure sensor 13. The fuel injection quantity is controlled by an output signal of the cylinder pressure sensor 13. When the fuel injection quantity is determined based on the pressure in the combustion changer 3 as stated above, irrespective of the running condition of the engine, the mixture having a predetermined air fuel ratio, can always be supplied to the combustion chamber 3. Next, explanation will be given to the reason referring to FIGS. 2 and 3. FIG. 2 shows the pressure change in the combustion chamber 3 from the compression stroke to the expansion stroke, when the intake air quantity (g) is maintained constant. The bold line shows the pressure change in firing time, and the dotted line shows the pressure change in motoring time. FIG. 2 shows that the pressure change in the firing time and that in motoring time are the same until the crank angle reach the points C. The crank angle C is about 40° before the upper dead center. On the other hand, FIG. 3 shows the relationship between the inner cylinder pressure P in the combustion chamber 3 at crank angle C, and the intake air quantity $G_a$ (g). This relationship is shown by a linear equation. This relationship is obtained in the motoring time. When the intake air quantity $G_a$ is constant, the pressure P in motoring time and that in firing time are the same at crank angle C. Therefore the relationship in FIG. 3 is established also in firing time. Therefore, when the pressure in the combustion chamber 3 is measured at the predetermined crank angle C, the intake air quantity $G_a$ which is actually sucked in the combustion chamber 3, can be known. Accordingly, when the fuel injection quantity is determined based on the pressure in the combustion chamber 3, the fuel being proportional to the intake air quantity $G_a$, can be supplied.

In case of the conventional device composed as above, when the engine revolution number is changed, the proportional relationship in FIG. 3 is changed. Therefore the intake air quantity can not accurately be detected. Furthermore, the inner cylinder pressure may vibrate, by which the intake air quantity can not accurately be detected. Since the timing in which the fuel quantity calculated based on the detected intake air quantity, is injected, is at the next cycle, there is a possibility of always containing an error. The above problems cause the lowering of engine performance, such as an increase of an output torque variation, the lowering of the output torque, the worsening of the fuel consumption ratio, and the increase of HC, or CO component in the exhaust gas, etc.

SUMMARY OF THE INVENTION

It is an object of the present invention to provide an electronic control fuel injection device for internal combustion engine, capable of accurately measuring the intake air quantity supplied to the respective cylinders, even when the intake air quantity changes, and making the air fuel ratio of the mixture to be supplied to the cylinder of the engine, agree with a predetermined air fuel ratio, in any case.

According to an aspect of the invention, there is provided an electronic control fuel injection device for an internal combustion engine which comprises:

an inner cylinder pressure sensor for detecting a pressure of a combustion chamber of the internal combustion engine;

a crank angle sensor for detecting a crank angle;

means for synthesizing the detected inner cylinder pressure by predetermined crank angles;

means for calculating an intake air quantity based on an engine revolution number which is obtained from the synthesized inner cylinder pressure and the crank angle;

means for synthesizing the calculated intake air quantity in predetermined cycles; and means for calculating a fuel injection quantity based on the synthesized intake air quantity.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
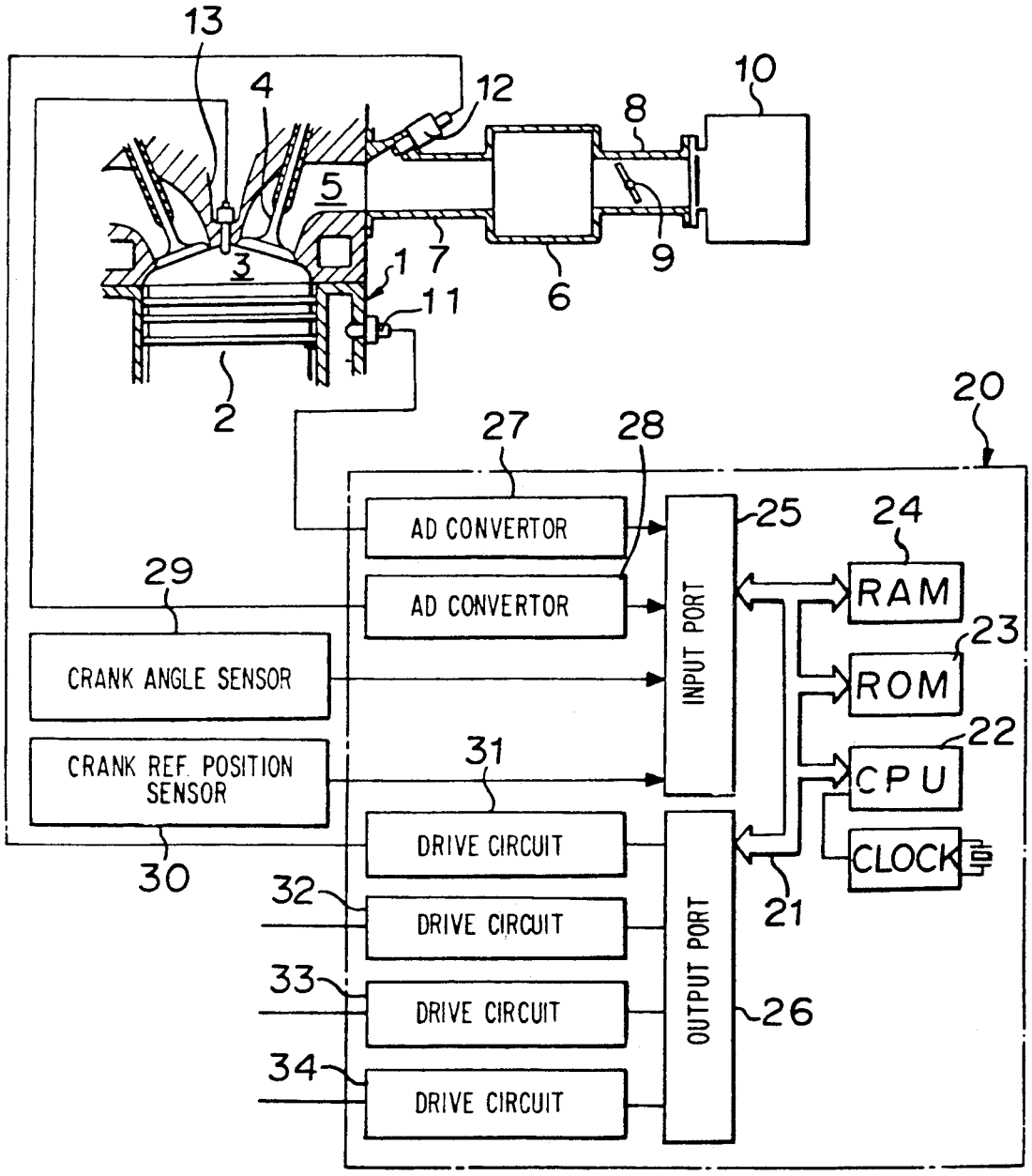
FIG. 1 is a constitutional diagram showing a conventional and invented device.
Figure 2:
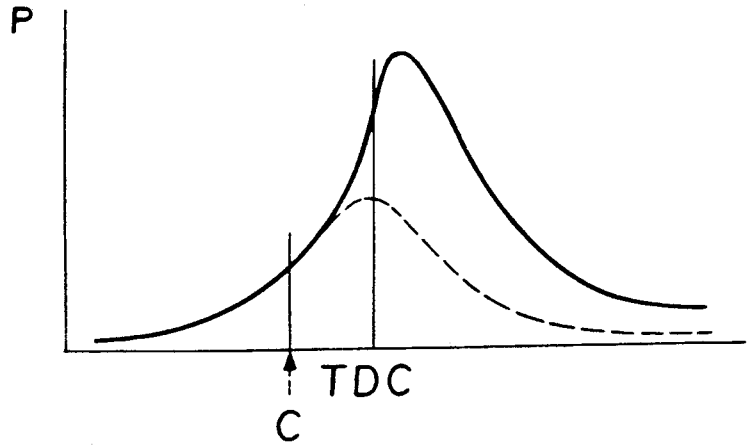
FIG. 2 is a diagram showing a relationship between a crank angle of the engine and inner cylinder pressure.
Figure 3:
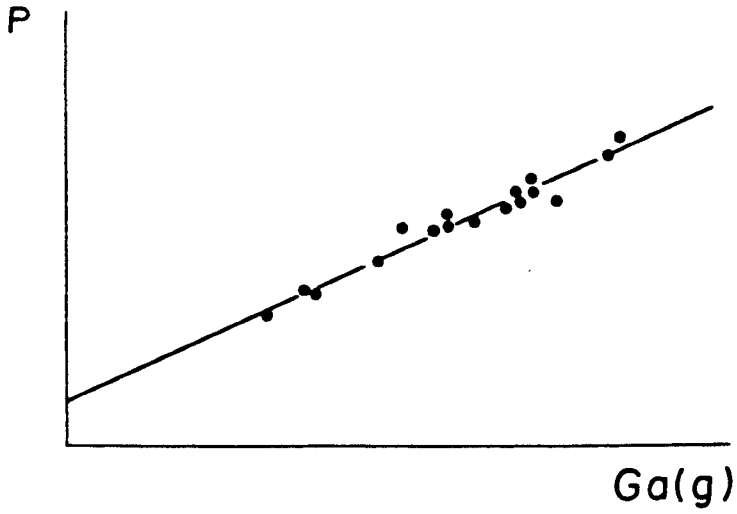
FIG. 3 is a diagram showing a relationship between the intake air quantity of the engine and the inner cylinder pressure.
Figures 4A, 4B, 4C, 4D, 4E, 4F:
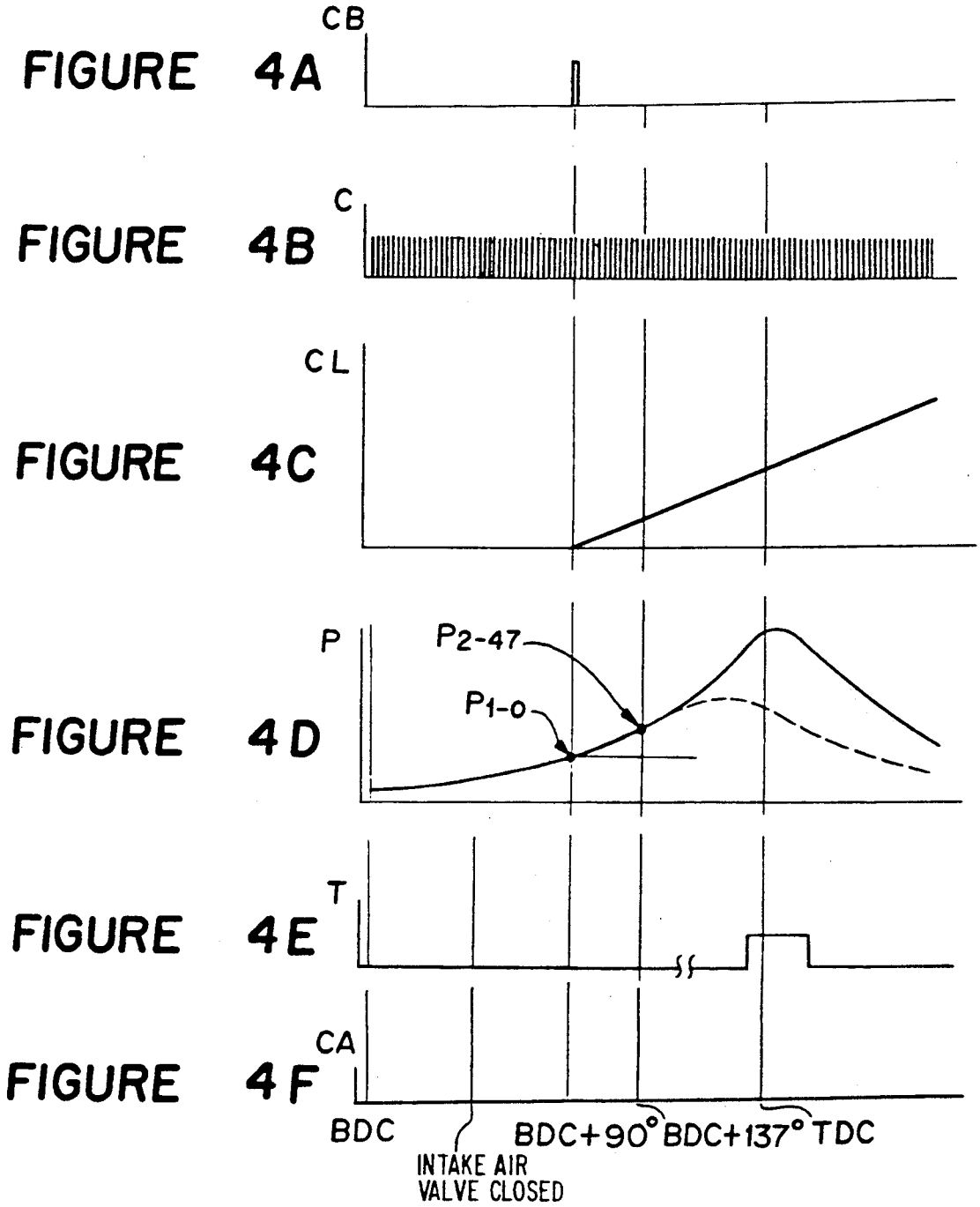
FIGS. 4A through 4F are timing charts showing control timing of the invented device.

Embodiments of the invention will be explained referring to the drawings. The constitution of the invention is the same with the conventional device shown in FIG. 1. FIGS. 4A to 4F show the control timing, in which CB is a reference position pulse signal which is generated by the crank reference position sensor 30, C, an output pulse signal which is generated at every unit crank angle, by the crank angle sensor 29, CL, a content of the crank angle counter, P, the inner cylinder pressure which is based on the calculation of the fuel injection quantity, T, a fuel injection period, and CA, a crank angle.

Next, explanation will be given to the operation of the fuel injection control referring to FIGS. 4 and 5.

Figure 5:
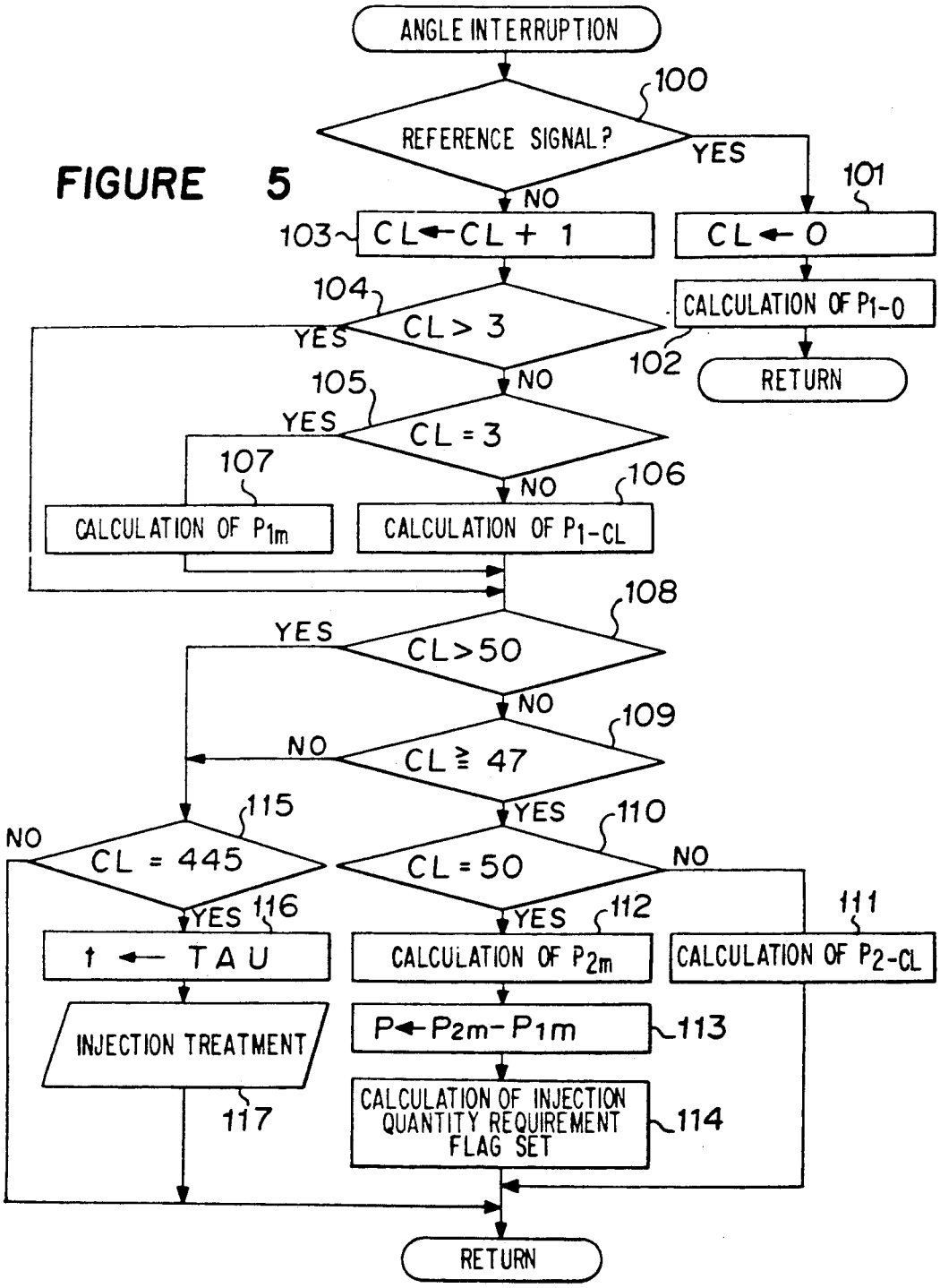
FIGS. 5 and 6 are flow charts showing the operation of the invented device.
Figure 7:
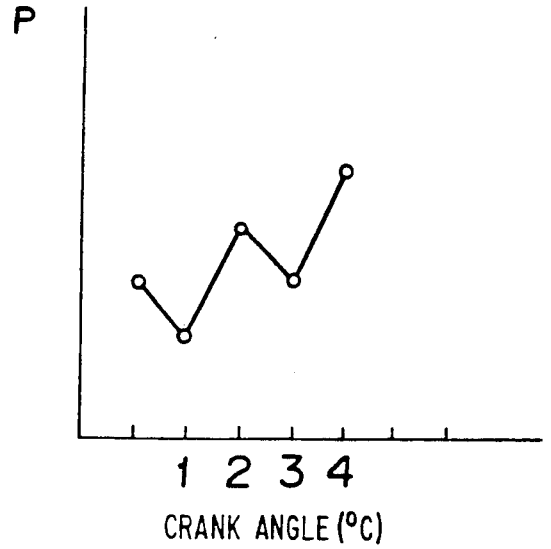
FIG. 7 is a diagram showing a variational state of the inner cylinder pressure of the engine.

The routine shown in FIG. 5 is started by an angle interruption. In Step 100, the operation determines whether the crank angle reference position sensor 30 generates the reference position pulse signal, that is, for instance, whether the piston 2 of the first cylinder is at the position 90° after the lower dead center in compression stroke. At 90° after the lower dead center of combustion stroke, the intake valve 4 and an exhaust valve are completely closed, and the cylinder is in a closed state. When the crank is at the reference position, in Step 101, the operation resets crank angle counter CL. In Step 102, the operation calculates the inner cylinder pressure from an output signal of the inner cylinder pressure sensor 13, which is memorized as $P_{1\text{-}0}$, by the RAM 24. When the crank is not in the reference position in Step 100, the operation goes to Step 103, in which the operation counts up the crank angle counter CL by 1. In Steps 104 through 107, the operation performs treatment of filtering the vibration of the inner cylinder pressure P. This filtering treatment is effective in the case that the inner cylinder pressure P vibrates at every 1 degree in crank angle, as shown in FIG. 7, and contributes to the stabilization of the air fuel control. Accordingly, in Step 104, the operation determines whether the crank angle counter CL surpasses 3. The determination is for averaging the inner cylinder pressure in the range of, for instance, 4 degrees in crank angle. When NO, the crank angle counter CL is 1 or 2 or 3. When YES, the operation goes to Step 108. In Step 105, the operation determines whether CL=3. When NO, in Step 106, the operation calculates the inner cylinder pressure from an output signal of the inner pressure sensor 13, which is memorized as $P_{1\text{-}CL}$ by the RAM 24. For example, when CL =2, the corresponding inner cylinder pressure is memorized as $P_{1\text{-}2}$, by RAM 24. When YES, the operation goes to Step 107, and calculates an average value $P_{1m}$ of the inner cylinder pressure using the current inner cylinder pressure $P_{1\text{-}3}$ and $P_{1\text{-}0}$, $P_{1\text{-}1}$, $P_{1\text{-}2}$, memorized in the RAM 24, by equation (1), which is memorized newly in the RAM 24.

$$P_{1m} = \frac{P_{1-0} + P_{1-1} + P_{1-2} + P_{1-3}}{4} \quad (1)$$

Next, the operation calculates the average value $P_{2m}$ of the second inner cylinder pressure, in Steps 108 through 112. First of all, in Step 108, the operation determines whether CL>50. When YES, the operation goes to Step 115. When NO, the operation goes to Step 109, and determines whether CL≧47. When YES, CL is 47 or 48 or 49 or 50, and in Step 110, the operation determines whether CL=50. When NO, the operation goes to Step 111, and calculates the inner cylinder pressure from output signal of the inner pressure sensor 13, which is memorized as $P_{2\text{-}CL}$ by the RAM 24. When YES, the operation goes to Step 112, and calculates the average value $P_{2m}$ of the inner pressure cylinder by using the current inner cylinder pressure $P_{2\text{-}50}$, and $P_{2\text{-}47}$, $P_{2\text{-}48}$, and $P_{2\text{-}49}$ which are memorized in the RAM 24, by equation (2), which is memorized newly in the RAM 24.

$$P_{2m} = \frac{P_{2-47} + P_{2-48} + P_{2-49} + P_{2-50}}{4} \quad (2)$$

Next, in Step 113, the operation calculates the difference P using the average values $P_{1m}$ and $P_{2m}$ of the inner cylinder pressure, by the equation (3)

$$P = P_{2m} - P_{1m} \quad (3)$$

Next, in Step 114, the operation set a flag of the requirement for calculation of fuel injection quantity. When this flag is set, the calculation of the fuel injection time is performed, as mentioned later. In Step 115, the operation determines whether CL=445, that is, whether it is the fuel injection timing. When CL=445, that is, it is the fuel injection timing, the operation goes to Step 116, and reads in the data TAU which represents the fuel injection time calculated as mentioned later, from the RAM 24 to the CPU 22, which is converted to the fuel injection time t. In Step 117, fuel injection is performed based on the fuel injection timing P.

Figure 6:
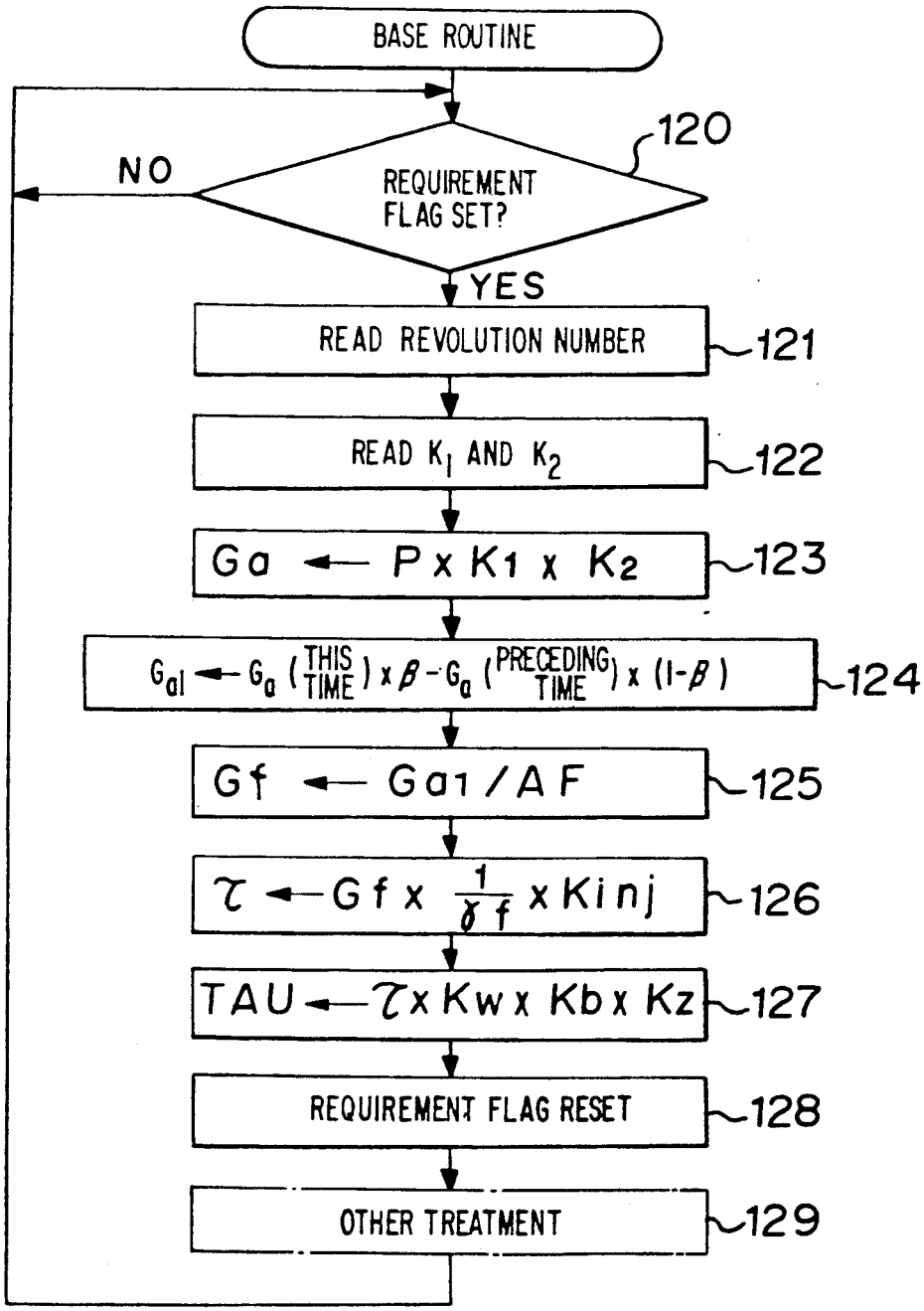

Next, explanation will be given to the calculation of the fuel injection time referring to the FIG. 6. First of all in Step 120, the operation determines whether the flag of requirement for calculation of fuel injection quantity, (refer to Step 114) is set. When the flag is set, the operation goes to Step 121, in which the current revolution number is read in. The revolution number can be calculated by counting of the crank angle counter CL in a predetermined time.

Figure 8:
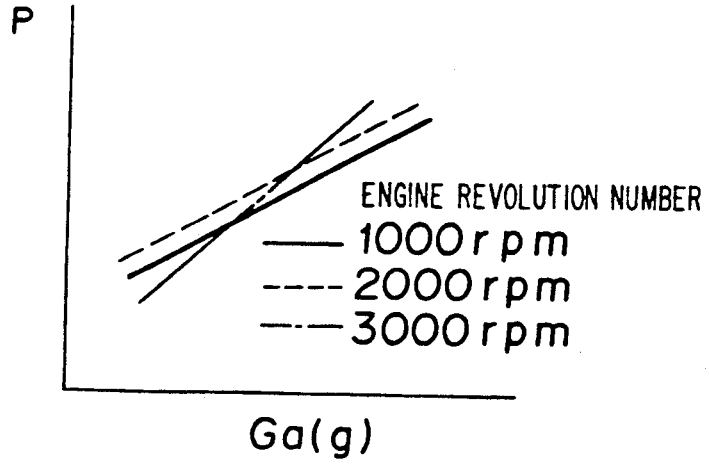
FIG. 8 is a diagram showing a relationship between the intake air quantity and the inner cylinder pressure, having a parameter of the engine revolution number.

In Step 122, the operation reads the coefficients for calculating the intake air quantity, $K_1$ and $K_2$, from the data Table shown in Table 1. The relationship in the Table 1 is obtained by experiment, which is based on the relationship in FIG. 8. Next, in Step 123, the operation calculates the intake air quantity $G_a$ (g) from the relationship of equation 4. P is the P obtained in Step 113.

TABLE 1

| Revolution No. | $K_1$ | $K_2$ |
|---|---|---|
| 1000 | 0.0933 | −0.0373 |
| 2000 | 0.0927 | −0.0495 |
| 3000 | 0.0893 | −0.0479 |
| 4000 | 0.0792 | −0.0155 |
| 5000 | 0.0828 | −0.0330 |
| 6000 | 0.0893 | −0.0564 |

$$G_a = P \times K_1 \times K_2 \quad (4)$$

Next, in Step 124, the operation performs the correction of the intake air quantity by equation (5) using the current intake air quantity and the intake air quantity of the preceding cycle.

$$G_{al} = G_a \text{ (this time)} \times \beta + G_a \text{ (1 cycle before)} \times (1 - \beta) \quad (5)$$

Where $\beta$ is a stabilization constant determined by experiment, and $0<\beta<1$. Next, in Step 125, the operation obtains the basic fuel injection quantity $G_f$ by $G_f = G_{al}/AF$, from the intake air quantity $G_{al}$ and the required air fuel ratio AF. In Step 126, the operation calculates the basic fuel injection time $\tau$ from equation (6).

$$\tau = G_f \times \frac{1}{\gamma_f} \times k_{inj} \quad (6)$$

where $\gamma_f$ is an air fuel ratio in weight, and $K_{inj}$ is a capacity coefficient of the fuel injection valve 12. In Step 127, the operation calculates the actual fuel injection time TAU. TAU is calculated by equation (7) using the cooling water temperature correction coefficient $K_w$, the battery voltage correction coefficient $K_b$, and other correction coefficient $K_z$.

$$TAU = \tau \times K_w \times K_b \times K_z \quad (7)$$

The obtained TAU is memorized in the RAM 24, as the data showing the fuel injection time. Next, in Step 128, the operation resets the flag of requirement for calculation of fuel injection quantity. In Step 129, the operation performs the other necessary treatments.

Furthermore, in the above embodiment, the case is shown, in which fuel injection is performed independently at respective cylinders (sequential injection). However, it is possible to perform simultaneous injection for all cylinders. In this case, the number of injections can be increased to plural times, and it is possible to optimize the fuel injection quantity with respect to each cylinder, by introducing air fuel ratio correction coefficient with respect to each cylinder. Furthermore it is possible to treat the inner pressure signal, which is combined with the devices for detecting generated torque or knocking. It is possible to detect the engine load from the detected intake air quantity, and to regulate the ignition time.

As mentioned above according to the present invention, the intake air quantity is obtained by the inner cylinder pressure and the engine revolution number, by which the intake air quantity is accurately obtained. The fuel injection quantity is determined based on this intake air quantity. Therefore it is possible to make the air fuel ratio of the mixture to be supplied to the combustion chamber, agree with a predetermined air fuel ratio. Furthermore, a filtering treatment is carried out by synthesizing the inner cylinder pressure, and a stabilization treatment is performed by synthesizing the intake air quantity. Therefore the air fuel control can be stably and accurately performed.

Obviously, numerous modifications and variations of the present invention are possible in light of the above teachings. It is therefore to be understood that within the scope of the appended claims, the invention may be practiced otherwise than as specifically described herein.

What is claimed is:

1. An electronic control fuel injection device for an internal combustion engine which comprises:

an inner cylinder pressure sensor for detecting a pressure of a combustion chamber of the internal combustion engine;

a crank angle sensor for detecting a crank angle;

means for synthesizing the detected inner cylinder pressure by predetermined crank angles;

means for calculating an intake air quantity based on an engine revolution number which is obtained from the synthesized inner cylinder pressure and the crank angle;

means for synthesizing the calculated intake air quantity in predetermined cycles; and means for calculating a fuel injection quantity based on the synthesized intake air quantity.

* * * * *